US008925149B2

(12) United States Patent
Chuang

(10) Patent No.: US 8,925,149 B2
(45) Date of Patent: Jan. 6, 2015

(54) GUIDING BLOCK OF CURTAIN

(71) Applicant: Shan-Chi Chuang, New Taipei (TW)

(72) Inventor: Shan-Chi Chuang, New Taipei (TW)

(73) Assignee: Syn Yao Enterprise Co. Ltd., New Taipei (TW)

( * ) Notice: Subject to any disclaimer, the term of this patent is extended or adjusted under 35 U.S.C. 154(b) by 0 days.

(21) Appl. No.: 13/898,301

(22) Filed: May 20, 2013

(65) Prior Publication Data

US 2014/0338150 A1 Nov. 20, 2014

(51) Int. Cl.
*E05D 15/00* (2006.01)
*A47H 15/02* (2006.01)

(52) U.S. Cl.
CPC ..... *A47H 15/02* (2013.01)
USPC ..... 16/87.2; 16/87.6 R; 16/87.4 R

(58) Field of Classification Search
USPC ..... 16/87.6 R, 87.2, 87 R, 87.4 R, 91, 97, 16/102, 107, 106, 45, 46; 160/330, 340, 160/341, 345–347, 123; 49/409, 410, 411, 49/412; 384/531–532
See application file for complete search history.

(56) References Cited

U.S. PATENT DOCUMENTS

| | | | | |
|---|---|---|---|---|
| 3,076,222 | A * | 2/1963 | Sloan | 16/98 |
| 3,293,685 | A * | 12/1966 | Rosenbaum | 16/87.6 R |
| 4,049,308 | A * | 9/1977 | Martin | 295/8 |
| 6,189,182 | B1 * | 2/2001 | Ko | 16/87.6 R |
| 7,937,808 | B1 * | 5/2011 | Chuang | 16/87.2 |
| 2007/0289090 | A1 * | 12/2007 | Cai | 16/87.2 |

* cited by examiner

*Primary Examiner* — Chuck Mah
(74) *Attorney, Agent, or Firm* — Che-Yang Chen; Law Office of Michael Chen

(57) ABSTRACT

An improved curtain guiding block structure may include a block body, a first wheel base, a second wheel base and a plurality of rolling balls. During the assembly process, the second wheel base is inserted into the circular hole of the block body from one side, and the first wheel base is inserted into the circular hole of the block body from the other side after the rolling balls are disposed therein; and the guiding post plugs into the through hole of the second wheel base to complete the assembly process without using any additional tools.

1 Claim, 4 Drawing Sheets

GUIDING BLOCK OF CURTAIN

FIELD OF THE INVENTION

The present invention relates to a guiding block structure, and more particularly to an improved guiding block structure of a curtain.

BACKGROUND OF THE INVENTION

Conventional structure of curtain guiding block is primarily to control the left and right movements of the curtain and the structure thereof generally is described in following Taiwanese patents: (1) TW 372436 (filing date: Aug. 6, 1998; titled: Curtain moving system) and (2) TW 355991 (filing date: Aug. 27, 1998; titled: Structure for guiding block of curtain). In these two Taiwanese patents, a right protruding portion of a right wheel base has a vertical slot and the right protruding portion is squeezed into a left protruding portion of the left wheel base. Since the block structure is very small and a hook-shaped structure has to be large enough to be effective, the vertical slot is less effective because the hook-shaped structure is too large and the right protruding portion of the right wheel base is difficult to be squeezed into the left protruding portion of the left wheel base.

Furthermore, in TW 253159 (filing date: Nov. 28, 1994), a right wheel base is inserted into a circular slot of a substrate and restricted by a protruding edge of the circular slot, and a plurality of rolling balls and a left wheel base are orderly disposed thereon. Finally, a protruding circle of the circular slot is heated and compressed to enclose and restrict the left wheel base. This process is inconvenient and costly because the user has to incorporate and purchase an additional heat/compress machine. Therefore, there remains a need for a new and improved guiding block structure to overcome the problems stated above.

SUMMARY OF THE INVENTION

The technical problem the present invention wants to solve is that the integration of the right and left wheel bases is conventionally inefficient and troublesome, and sometimes it needs an additional machine to complete the assembly process, which is inconvenient and costly.

The present invention provides an improved structure of a curtain guiding block includes a block body, a first wheel base, a second wheel base and a plurality of rolling balls. A circular hole is located at upper portion of the block body, and a hanging board extends at lower portion thereof. The first wheel base has a stopping portion, and a connecting protruding post corresponding to the circular hole of the block body. A guiding post extends from center portion of the connecting protruding post and a connecting slot is recessedly formed at front portion of the guiding post, and rear portion of the guiding post has a blocking portion. The second wheel base has a top portion and an engaging protruding post corresponding to the circular hole of the block body. A connecting protruding portion extends from center portion of the engaging protruding post, and diameter of the connecting protruding portion is greater than the guiding post. Also, a through hole is formed axially and the top portion is hollow and an engaging post extends from the through hole. The engaging post is hollow as well and has a guiding slot to connect with the through hole, and a plurality of cut slots is axially formed on the outer wall thereof, and a conjugating portion is protrudingly formed at the inner portion of a rear opening thereof. A plurality of rolling balls are disposed at the circular hole of the block body and restricted between the first wheel base and the second wheel base.

Comparing with the prior arts, the present invention is advantageous because during the assembly process, the second wheel base is inserted into the circular hole of the block body from one side, and the first wheel base is inserted into the circular hole of the block body from the other side after the rolling balls are disposed therein; and the guiding post plugs into the through hole of the second wheel base to complete the assembly process without using any additional tools.

Furthermore, the guiding slot is formed within the hollow top portion of the second wheel base and a plurality of cut slots are formed at the outer wall of the engaging post that has protruding conjugating portion therein, so that when the guiding post of the block body passes through, the connecting slot and the conjugating portion are secured and restricted to increase the structural strength of the guiding block in the present invention.

DETAILED DESCRIPTION OF THE INVENTION

The detailed description set forth below is intended as a description of the presently exemplary device provided in accordance with aspects of the present invention and is not intended to represent the only forms in which the present invention may be prepared or utilized. It is to be understood, rather, that the same or equivalent functions and components may be accomplished by different embodiments that are also intended to be encompassed within the spirit and scope of the invention.

Unless defined otherwise, all technical and scientific terms used herein have the same meaning as commonly understood to one of ordinary skill in the art to which this invention belongs. Although any methods, devices and materials similar or equivalent to those described can be used in the practice or testing of the invention, the exemplary methods, devices and materials are now described.

All publications mentioned are incorporated by reference for the purpose of describing and disclosing, for example, the designs and methodologies that are described in the publications that might be used in connection with the presently described invention. The publications listed or discussed above, below and throughout the text are provided solely for their disclosure prior to the filing date of the present application. Nothing herein is to be construed as an admission that the inventors are not entitled to antedate such disclosure by virtue of prior invention.

Figure 1:
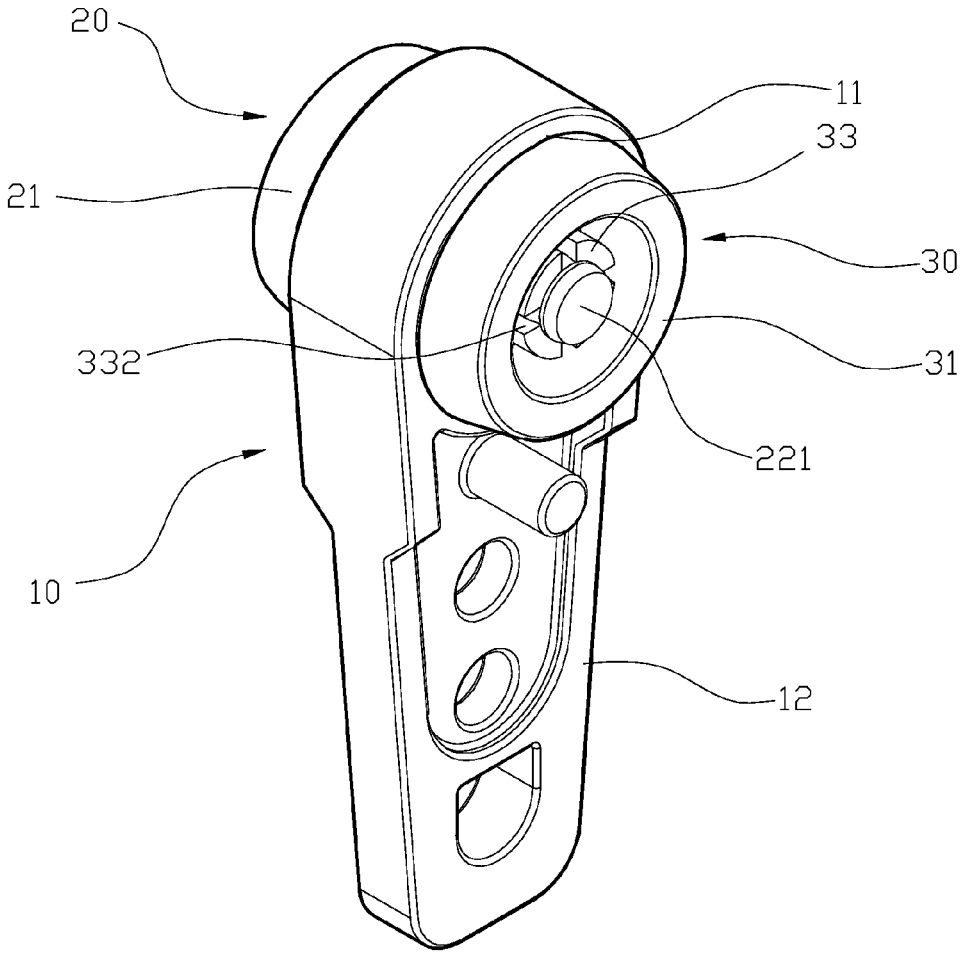
FIG. 1 illustrates a three-dimensional view of the present invention.
Figure 2:
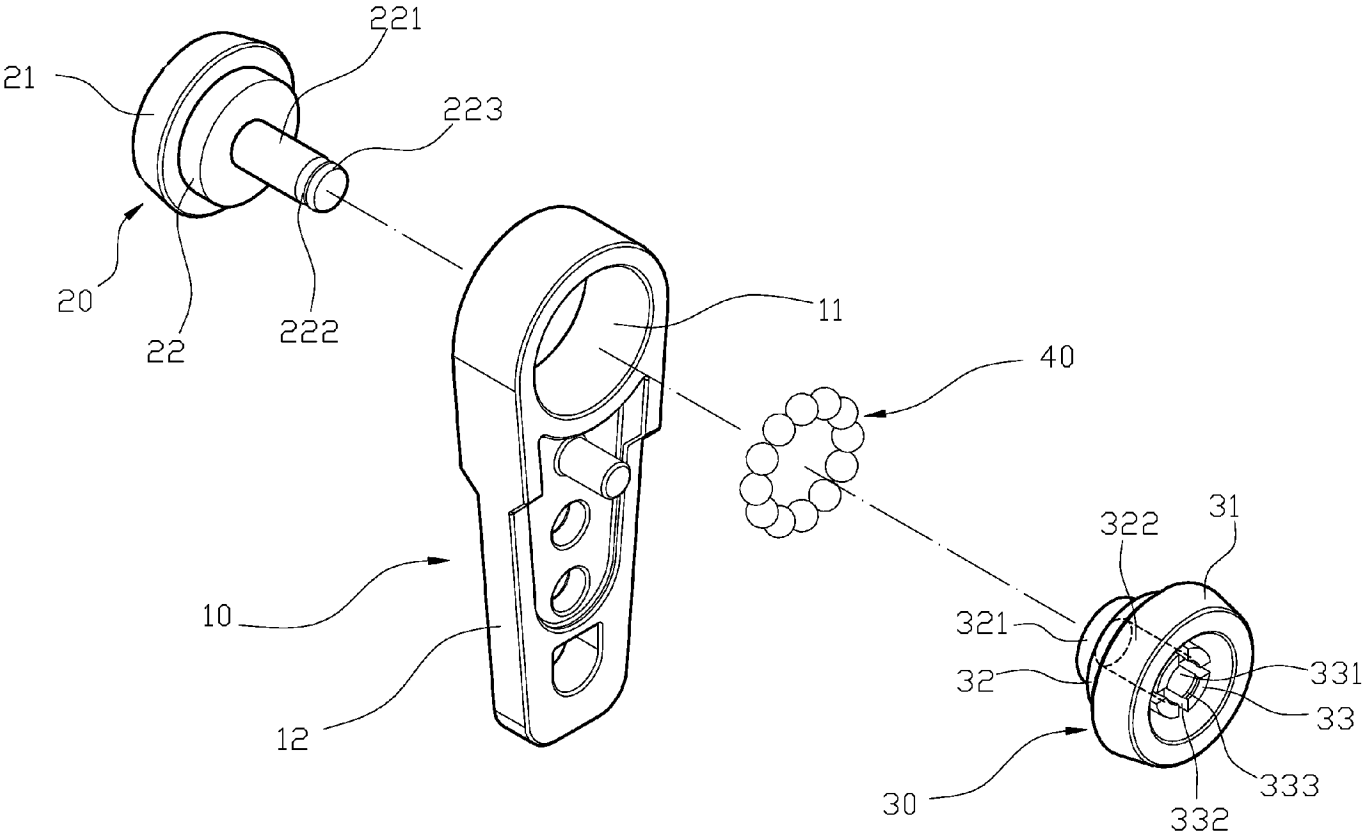
FIG. 2 illustrates an exploded view of the present invention.

In order to further understand the goal, characteristics and effect of the present invention, a number of embodiments along with the drawings are illustrated as following:

Referring to FIGS. 1 to 2, an improved structure of a curtain guiding block includes a block body (10), a first wheel base (20), a second wheel base (30) and a plurality of rolling balls (40). A circular hole (11) is located at upper portion of the block body (10), and a hanging board (12) extends at lower portion thereof. The first wheel base (20) has a stopping portion (21), and a connecting protruding post (22) corresponding to the circular hole (11) of the block body (10). A guiding post (221) extends from center portion of the connecting protruding post (22) and a connecting slot (222) is recessedly formed at front portion of the guiding post (221), and rear portion of the guiding post (221) has a blocking portion (223). The second wheel base (30) has a top portion (31) and an engaging protruding post (32) corresponding to the circular hole (11) of the block body (10). A connecting protruding portion (321) extends from center portion of the engaging protruding post (32), and diameter of the connecting protruding portion (321) is greater than the guiding post (221). Also, a through hole (322) is formed axially and the top portion (31) is hollow and an engaging post (33) extends from the through hole (322). The engaging post (33) is hollow as well and has a guiding slot (331) to connect with the through hole (322), and a plurality of cut slots (332) is axially formed on the outer wall thereof, and a conjugating portion (333) is protrudingly formed at the inner portion of a rear opening thereof. A plurality of rolling balls (40) are disposed at the circular hole (11) of the block body (10) and restricted between the first wheel base (20) and the second wheel base (30).

Figure 3:
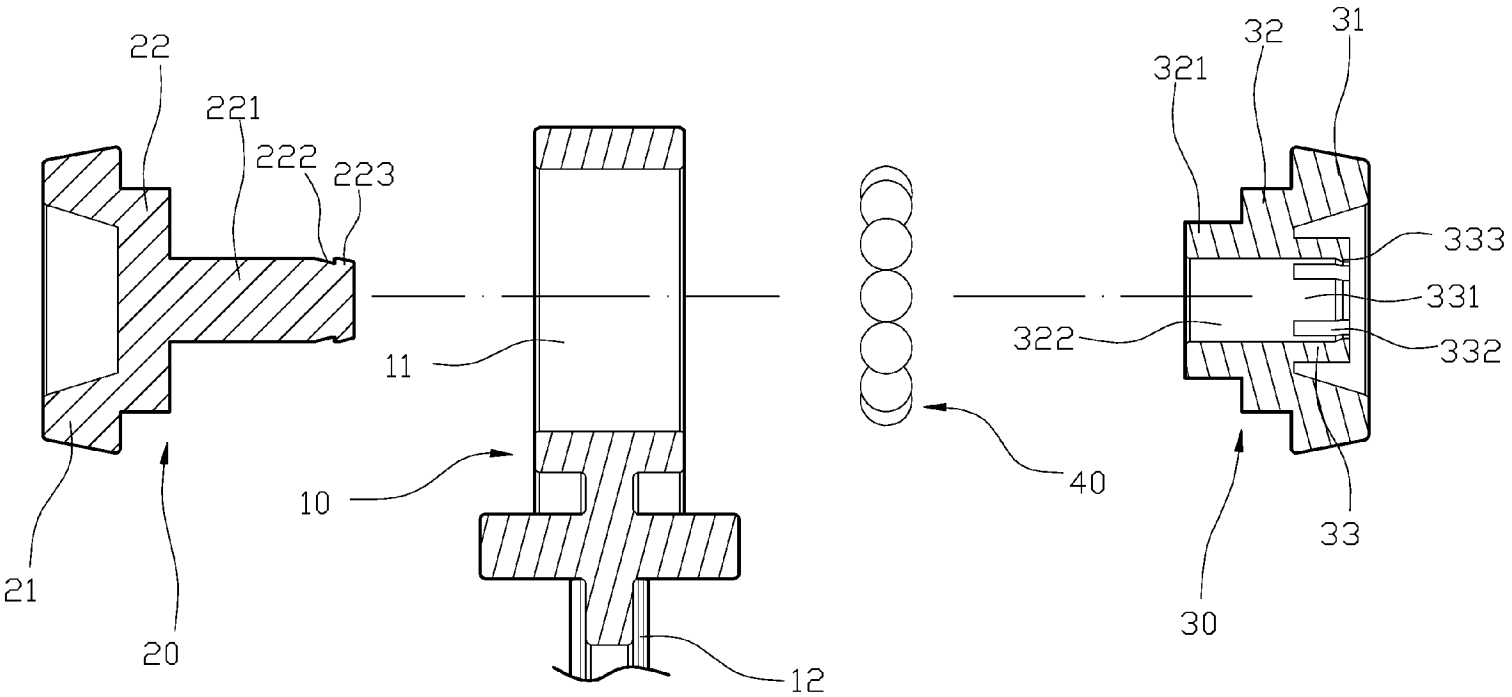
FIG. 3 illustrates a sectional and exploded view of the present invention.
Figure 4:
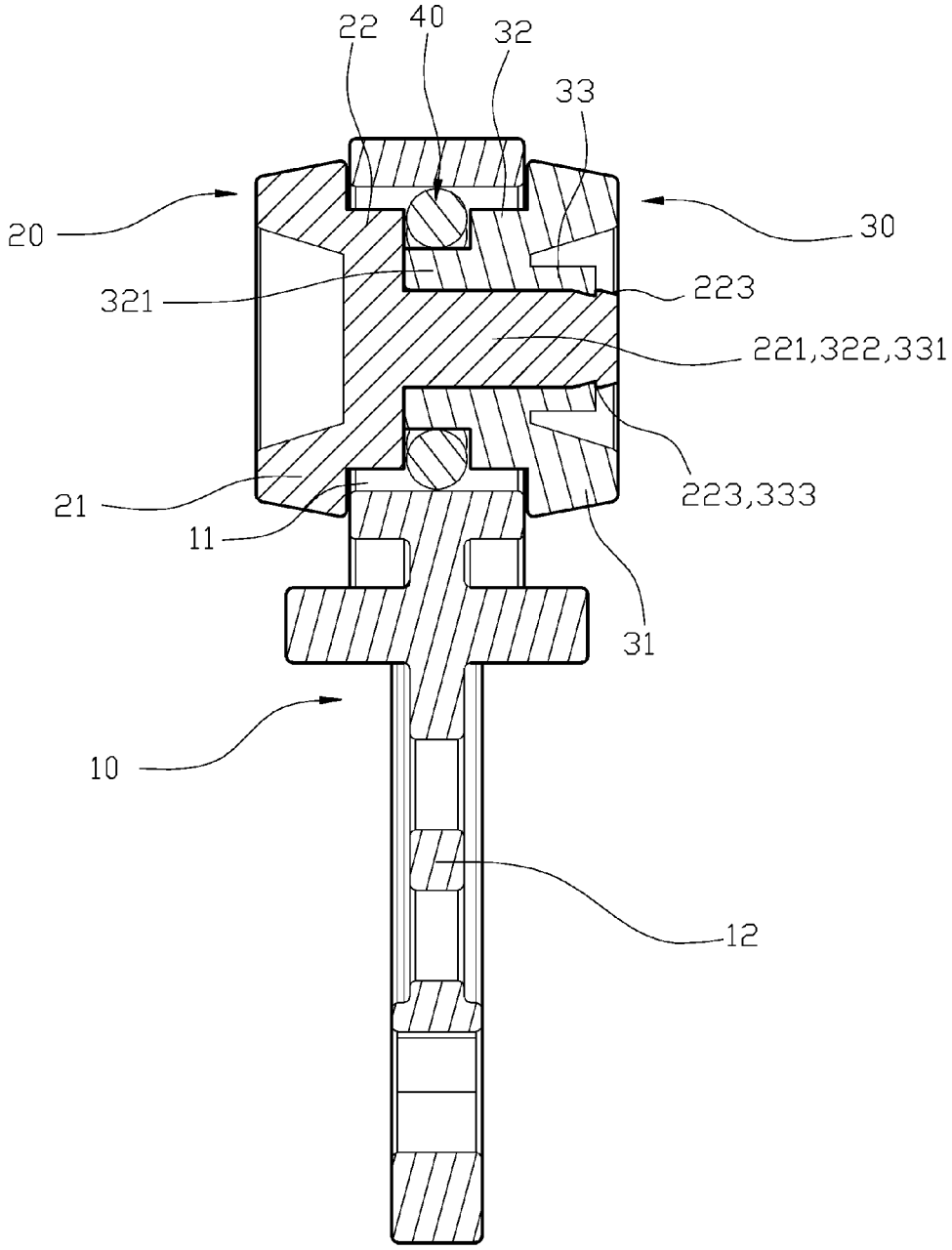
FIG. 4 illustrates a sectional and assembled in the present invention.

Referring to FIGS. 2 to 4 for the structure, the block body (10) has the circular hole (11), the first and second wheel bases (20, 30) and a plurality of rolling balls (40). The second wheel base (30) is conjugated with the circular hole (11) of the block body (10) with the engaging protruding post (32) and the top portion (31) is restricted outside the circular hole (11). Also, a plurality of rolling balls (40) are circularly disposed at the outer portion of the connecting protruding portion (321). The first wheel base (20) is conjugated with the circular hole (11) of the block body (10) with the connecting protruding post (22), and passes through the through hole (322) of the second wheel base (30) and the guiding slot (331) of the engaging post (33) with the guiding post (221). Moreover, the outer wall of the engaging post (33) has a plurality of cut slots (332) along the axial direction and when the guiding post (221) passes through the guiding slot (331) and the conjugating portion (333) with the blocking portion (223), the engaging post (33) outwardly expands due to the resilience of the cut slots (332), so the blocking portion (223) can pass through then stay in the connecting slot (222). Under such circumstances, the guiding post (221) and the engaging post (33) can be conjugated and secured, and the connecting protruding post (22) and the engaging protruding post (32) are used to restrict the rolling balls (40) in the block body (10). And the stopping portion (21) located at outer portion of the first wheel base (20) is just restricted outside the circular hole (11) to obtain an improved curtain guiding block structure.

According to the embodiments described above, the present invention is advantageous because (i) during the assembly process, the second wheel base (30) is inserted into the circular hole (11) of the block body (10) from one side, and the first wheel base (20) is inserted into the circular hole (11) of the block body (10) from the other side after the rolling balls (40) are disposed therein; and the guiding post (221) plugs into the through hole (322) of the second wheel base (30) to complete the assembly process without using any additional tools; and (ii) the guiding slot (331) is formed within the hollow top portion (31) of the second wheel base (30) and a plurality of cut slots (332) are formed at the outer wall of the engaging post (33) that has protruding conjugating portion (333) therein, so that when the guiding post (221) of the block body (10) passes through, the connecting slot (222) and the conjugating portion (333) are secured and restricted to increase the structural strength of the guiding block in the present invention.

Having described the invention by the description and illustrations above, it should be understood that these are exemplary of the invention and are not to be considered as limiting. Accordingly, the invention is not to be considered as limited by the foregoing description, but includes any equivalents.

What is claimed is:

1. A curtain guiding block comprising a block body, having a circular hole located at upper portion thereof;

a first wheel base, having a stopping portion, and a connecting protruding post corresponding to the circular hole of the block body, wherein a guiding post extends from a center portion of the connecting protruding post and a connecting slot is recessedly formed at a front portion of the guiding post, and a blocking portion extends from the connecting slot;

a second wheel base, having a top portion and an engaging protruding post corresponding to the circular hole of the block body, wherein a connecting protruding portion extends from center portion of the engaging protruding post, and the diameter of the connecting protruding portion is greater than the diameter of the guiding post, and a through hole is formed axially and the top portion is hollow and an engaging post extends from the through hole, wherein the engaging post is hollow and has a guiding slot to connect with the through hole, and a plurality of cut slots is axially formed on the outer wall thereof, and a conjugating portion is protrudingly formed at inner portion of a rear opening thereof; and a plurality of rolling balls disposed at the circular hole of the block body and restricted between the first wheel base and the second wheel base.

* * * * *